US008369550B2

(12) United States Patent
Choi et al.

(10) Patent No.: US 8,369,550 B2
(45) Date of Patent: Feb. 5, 2013

(54) ARTIFICIAL EAR AND METHOD FOR DETECTING THE DIRECTION OF A SOUND SOURCE USING THE SAME

(75) Inventors: JongSuk Choi, Seoul (KR); Youngin Park, Seoul (KR); Sangmoon Lee, Daegu (KR)

(73) Assignee: Korea Institute of Science and Technology, Seoul (KR)

( * ) Notice: Subject to any disclaimer, the term of this patent is extended or adjusted under 35 U.S.C. 154(b) by 329 days.

(21) Appl. No.: 12/764,401

(22) Filed: Apr. 21, 2010

(65) Prior Publication Data

US 2011/0129105 A1 Jun. 2, 2011

(30) Foreign Application Priority Data

Nov. 30, 2009 (KR) ..... 10-2009-0116695

(51) Int. Cl.
*H04R 25/00* (2006.01)

(52) U.S. Cl. ..... 381/313

(58) Field of Classification Search ..... 381/313
See application file for complete search history.

(56) References Cited

U.S. PATENT DOCUMENTS

| | | | | |
|---|---|---|---|---|
| 6,516,066 | B2 | 2/2003 | Hayashi | |
| 6,795,556 | B1 * | 9/2004 | Sibbald et al. | 381/17 |
| 7,362,654 | B2 | 4/2008 | Bitton | |
| 2006/0204023 | A1 * | 9/2006 | Stinson et al. | 381/122 |
| 2009/0003621 | A1 | 1/2009 | Greywall | |
| 2009/0086993 | A1 | 4/2009 | Kawaguchi et al. | |
| 2009/0285409 | A1 | 11/2009 | Yoshizawa et al. | |

FOREIGN PATENT DOCUMENTS

| | | | |
|---|---|---|---|
| EP | 2 202 531 | | 6/2010 |
| JP | 1993-066255 | | 3/1993 |
| JP | 1999-083982 | | 3/1999 |
| JP | 2001-153941 | | 6/2001 |
| JP | 2003-156552 | | 5/2003 |
| JP | 4339929 (B2) | | 10/2009 |
| KP | 1020020018511 | A | 3/2002 |
| KP | 1020030077797 | A | 10/2003 |
| KP | 1020080070196 | A | 7/2008 |
| KP | 10-2009-0016205 | | 2/2009 |
| KP | 1020090049761 | A | 5/2009 |
| KP | 1020090116089 | A | 11/2009 |
| KR | 10-2006-0130919 | A | 12/2006 |
| KR | 10-2007-0121570 | A | 12/2007 |
| KR | 10-0931401 | B1 | 12/2009 |
| WO | WO-00/37962 | | 6/2000 |

* cited by examiner

*Primary Examiner* — Jianchun Qin
(74) *Attorney, Agent, or Firm* — Dickstein Shapiro LLP

(57) ABSTRACT

Disclosed herein are an artificial ear and a method for detecting the direction of a sound source using the same. The artificial ear includes a plurality of microphones; and one or more structures disposed between the plurality of microphones. In the artificial ear, the amplitudes of output signals respectively inputted to the plurality of microphones are designed to be different based on the direction of a sound source. The method for detecting the direction of a sound source includes receiving output signals with different amplitudes from a plurality of microphones; determining front-back discrimination of the sound source from a difference between the amplitudes of the output signals of the microphones; and determining an angle corresponding to the position of the sound source from a difference between delay times of the output signals of the microphones.

3 Claims, 8 Drawing Sheets

ARTIFICIAL EAR AND METHOD FOR DETECTING THE DIRECTION OF A SOUND SOURCE USING THE SAME

CROSS-REFERENCE TO RELATED APPLICATION

This application claims priority from and the benefit of Korean Patent Application No. 10-2009-116695, filed on Nov. 30, 2009, which is hereby incorporated by reference for all purposes as if fully set forth herein.

BACKGROUND

1. Field of the Invention

Disclosed herein are an artificial ear and a method for detecting the direction of a sound source using the same.

2. Description of the Related Art

Recently, much interest has been focused on industries for intelligent robots that can interact with human beings. It is important that a robot detect the exact position of a robot user who is a conversational partner for Human-Robot Interaction (HRI). Therefore, a technique for detecting the direction of a sound source using an acoustic sensor is one of essential techniques for HRI.

The related art technique for detecting the direction of a sound source includes a method using Time Delay Of Arrivals (TDOA), a method using a Head-Related Transfer Function (HRTF) database of a robot platform, a beam-forming method using a plurality of microphone arrays, and the like.

The method using the TDOA is a method for estimating the direction of a sound source using a delay time at which a sound of a speaker arrives at each sensor. Since the method has a simple algorithm and a small amount of calculation, it is frequently used for estimating the position of a sound source in real time. However, when there is a constraint that a microphone should be disposed in a narrow area such as the position of each person's ear, i.e., when the distance between the microphones is shortened, the method is disadvantageous in that estimation resolution is reduced. When only two microphones are used in a narrow area, a sound source has the same delay time at two positions on a two-dimensional plane, and therefore, front-back confusion occurs. That is, if the position of a sound source is estimated based on only the delay time difference when only the two microphones are used, front-back discrimination is impossible.

The method using the HRTF is a method for detecting the direction of a sound source using information on the magnitude and phase of HRTFs. The method is similar to the sound source direction detecting method of human beings, but a change in transfer function, caused by an external ear, is shown in a frequency domain higher than the sound frequency area (~4 kHz). Therefore, the method is disadvantageous in that a relatively large-sized artificial ear is needed and the amount of database for sound source direction detection is increased.

The beam-forming method is a method for matching a vector of a virtual sound source to a position vector of a real sound source while rotating the vector of the virtual sound source. In the beam-forming method, an array having a plurality of fixed sensors is necessarily used. When a plurality of microphones is used, a high-end hardware for signal processing is required, and the amount of data to be processed is increased. Therefore, the beam-forming method is disadvantageous in that it is unsuitable for detecting the direction of a sound source in real time.

In the related art techniques, the relative position between a sound source and a microphone is changed in real time. When the arrangement of microphones is restricted due to the shape of a robot platform, there is a limitation in applying the related art techniques.

SUMMARY OF THE INVENTION

Disclosed herein are an artificial ear in which a difference between output signals respectively inputted to a plurality of microphones, generated by one or more structures disposed between the plurality of microphones so that front-back confusion can be prevented and the direction of a sound source can be detected in real time. Therefore, the artificial ear to various robot platforms using the localization method for detecting the direction of a sound source using the artificial ear can be applied.

In one embodiment, there is provided an artificial ear including a plurality of microphones; and one or more structures disposed between the plurality of microphones, wherein the amplitudes of output signals respectively measured by a plurality of microphones are designed to be different based on the direction of a sound source.

In one embodiment, there is provided a method for detecting the direction of a sound source, which includes receiving output signals with different amplitudes from a plurality of microphones; determining front-back discrimination of the sound source from a difference between the amplitudes of the output signals of the microphones; and determining an angle corresponding to the position of the sound source from a difference between delay times of the output signals of the microphones.

BRIEF DESCRIPTION OF THE DRAWINGS

The above and other aspects, features and advantages of the present invention will become apparent from the following description of preferred embodiments given in conjunction with the accompanying drawings, in which.

DETAILED DESCRIPTION OF THE INVENTION

Figure 1:
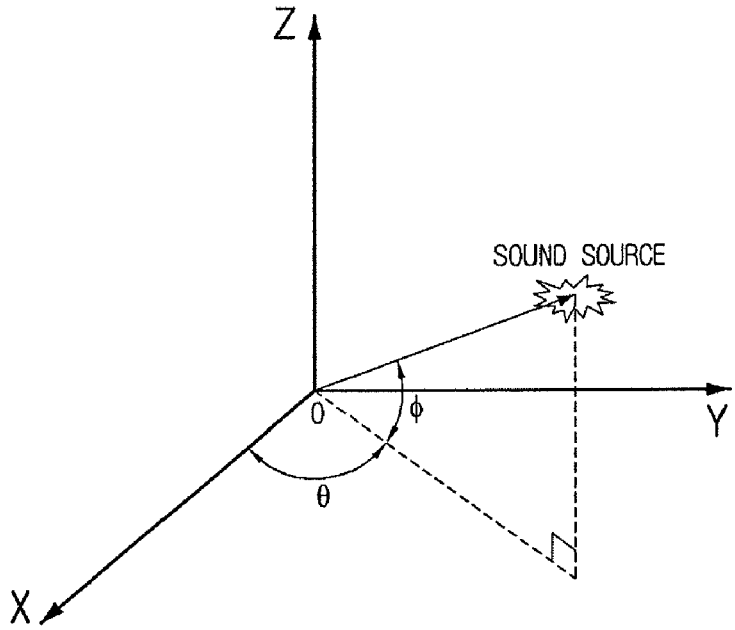
FIG. 1 is a view showing vertical-polar coordinates.

Exemplary embodiments now will be described more fully hereinafter with reference to the accompanying drawings, in which exemplary embodiments are shown. This disclosure may, however, be embodied in many different forms and should not be construed as limited to the exemplary embodiments set forth therein. Rather, these exemplary embodiments are provided so that this disclosure will be thorough and complete, and will fully convey the scope of this disclosure to those skilled in the art. In the description, details of well-known features and techniques may be omitted to avoid unnecessarily obscuring the presented embodiments.

The terminology used herein is for the purpose of describing particular embodiments only and is not intended to be limiting of this disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, like reference numerals in the drawings denote like elements. The shape, size and regions, and the like, of the drawing may be exaggerated for clarity.

Conventionally, sensors for sound source direction detection applied to a robot were mainly arranged in the form of an array of microphones widely spread in a robot platform. However, in order to use sensors as an acoustic system of a humanoid robot, it is necessary for the position of the sensors to be closer to the position of a person's ear for more natural HRI. To this end, a structure of an artificial ear using a small number of microphones and an earflap copied from a person's external ear, which is applied to a robot for sound source direction detection, is proposed.

FIG. 1 is a view showing vertical-polar coordinate. If it is assumed that an artificial ear according to an embodiment is raised from the ground, the elevation angle $\phi$ of a sound source that exists on a center plane with a horizontal angle $\theta$ of zero degree, i.e., a two-dimensional plane, may be estimated using the structure of the artificial ear. Alternatively, if it is assumed that the artificial ear according to an embodiment is laid down on the ground, the horizontal angle $\theta$ of a sound source that exists on a plane with an elevation angle $\phi$ of zero degree may be estimated.

Figure 2:
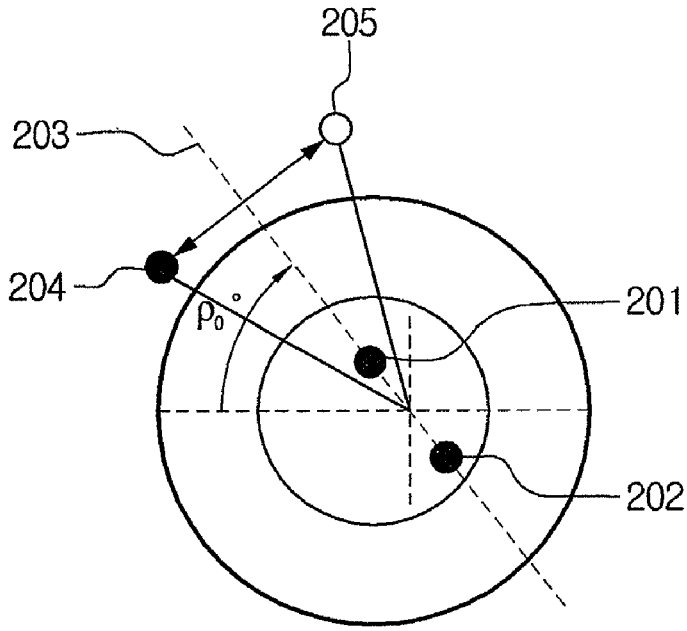
FIG. 2 is a view illustrating front-back confusion of a sound source when two microphones are arranged in a narrow area.

FIG. 2 is a view illustrating front-back confusion of a sound source when two microphones are arranged in a narrow area. If two microphones 201 and 202 are arranged in a narrow area such as the position of a person's ear and the direction of a sound source that exists on a two-dimensional plane is estimated, an inter-channel level difference (IcLD) and an inter-channel time difference (IcTD) are identical to each other at two points that are symmetric to each other with respect to a line 203 passing through two microphones 201 and 202. Referring to FIG. 2, the position 205 of a virtual sound source is positioned symmetric to the position 204 of a real sound. Therefore, an estimation error is considerably increased due to the confusion between the position 204 of the real sound source and the position 205 of the virtual sound source, which is called as front-back confusion.

Figure 3:
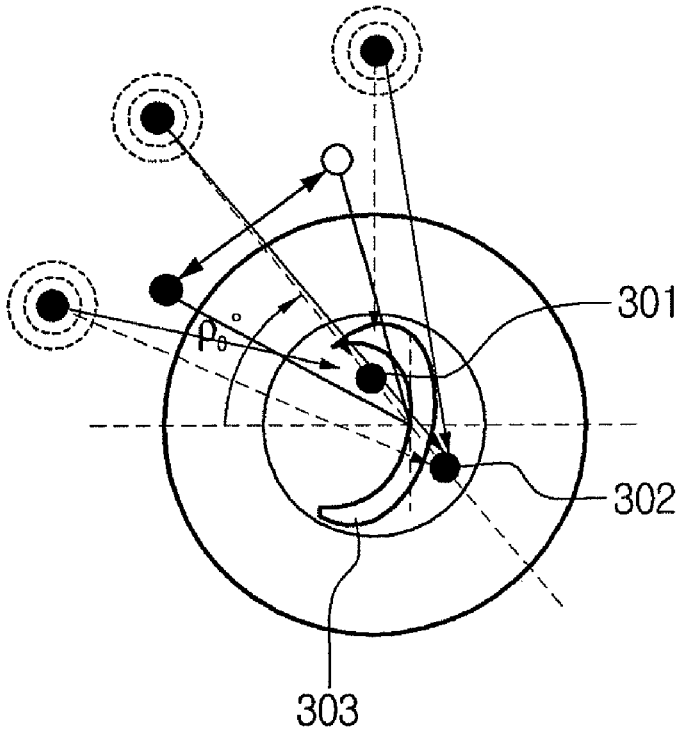
FIG. 3 is a view showing an exemplary arrangement of two microphones and a structure in order to prevent the front-back confusion of FIG. 2 according to an embodiment.

FIG. 3 is a view showing an exemplary arrangement of two microphones and a structure in order to prevent the front-back confusion of FIG. 2 according to an embodiment. Although it has been described in this embodiment that two microphones and one structure are used, it will be readily understood by those skilled in the art that the number of microphones and the number of structures may be adjusted if necessary. The arrangement of the microphones and the structure is also provided only for illustrative purposes, and the microphones and the structure may be appropriately arranged if necessary.

Referring to FIG. 3, the artificial ear according to an embodiment of the invention includes two microphones 301 and 302 having different channels from each other and a structure 303 disposed between the two microphones 301 and 302. The structure 303 may induce a difference between output signals that are radiated from a sound source for detecting its direction and respectively inputted to the two microphones 301 and 302.

Figure 4A:
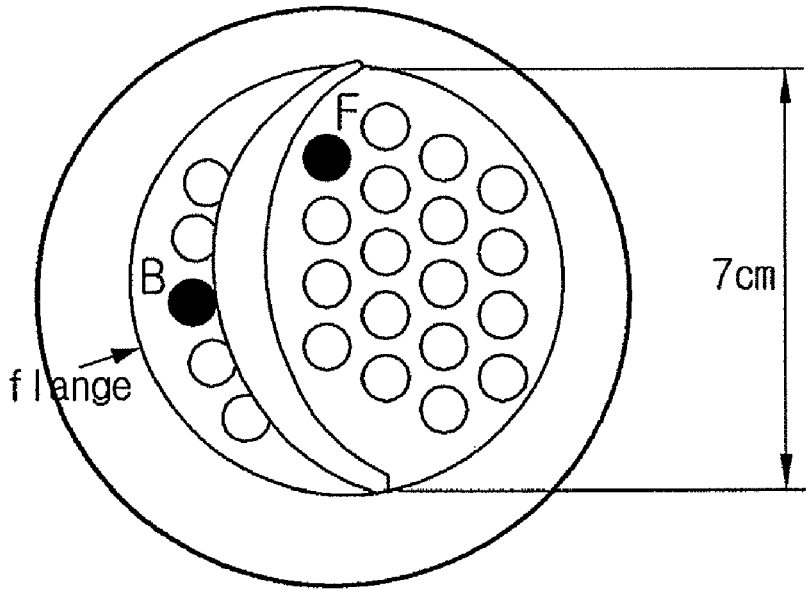
FIGS. 4A and 4B are views showing an artificial ear according to an embodiment.

According to one embodiment, the structure 303 may be designed to have a shape similar to an earflap in a person's ear, and is hereinafter referred to as an earflap. The difference between output signals respectively inputted to the two microphones 301 and 302 is induced by the structure 303, and accordingly, the front-back discrimination of the direction of a sound source can be accomplished. Based on such an idea, an artificial ear is manufactured so that an earflap model with a length of 7 cm and microphones can be attached thereto, which is shown in FIG. 4A. In order to select the optimal positions of the microphones, a plurality of holes are formed in the artificial ear so that an experiment using a plurality of microphones can be performed. The optimal positions of the microphones selected finally are shown in FIG. 4B.

Figure 4B:
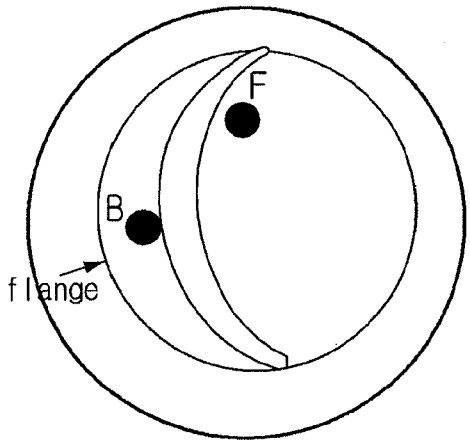
Figure 5:
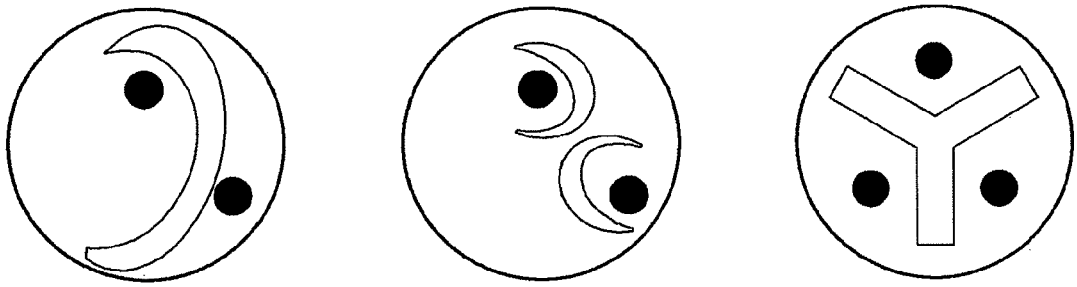
FIG. 5 is a view illustrating various arrangements of microphones and structures in artificial ears disclosed herein.

The artificial ear shown in FIGS. 4A and 4B is provided only for illustrative purposes, and may be variously implemented based on the number or arrangement of microphones and structures. FIG. 5 is a view illustrating various arrangements of microphones and structures in artificial ears disclosed herein.

Referring back to FIG. 3, the front-back discrimination is achieved through the microphones respectively arranged at the front and back of the earflap. That is, when a sound source is positioned in front of the microphones 301 and 302, the amplitude of a signal measured from the first microphone 301 positioned in front of the second microphone 302 is greater than that of a signal measured from the second microphone 302 positioned at the back of the first microphone 301. On the other hand, when the sound source is positioned at the back of the microphones 301 and 302, the amplitude of a signal measured from the second microphone 302 is greater than that of a signal measured from the first microphone 301. In this case, two output signals of the two microphones 301 and 302 are used to estimate the direction of a real sound source. Since the microphones 301 and 302 have different channels from each other, the transfer function between the positions of the microphones 301 and 302 is represented by an inter-channel transfer function (IcTF). The IcTF is defined by Equation 1.

$$IcTF_{FB}(f_k) = \frac{G_{FB}(f_k)}{G_{BB}(f_k)} = |IcTF(f_k)|e^{j \cdot phase(f_k)} \quad (1)$$

Here, $G_{FB}(f_k)$ denotes a cross power density function between the output signals of the first and second microphones 301 and 302, and $G_{BB}(f_k)$ denotes a power spectral density function of the output signal of the second microphone 302.

The IcLD for comparing the amplitudes of the output signals of the two microphones 301 and 302 is defined by Equation 2.

$$IcLD = 20\log_{10}(|IcTF(f)|) = \frac{\sum_{n=0}^{n=N-1} 20\log_{10}(|IcTF_{FB}(f_n)|)df_n}{\sum_{n=0}^{n=N-1} df_n} \text{ dB} \quad (2)$$

The amplitude ratio of the output signals measured above can be measured as a level of the IcTF, and accordingly, the front-back differentiation can be accomplished.

By using the artificial ear according to one embodiment, the front-back discrimination is possible with respect to the position at the amplitudes of the output signals of the respective microphones relatively positioned in front of and at the back of the earflap are identical to each other, i.e., IcLD=0. When the IcLD is greater than zero, it is estimated that the position of the sound source is positioned in front of the line passing through the microphones. When the IcLD is smaller than zero, it is estimated that the position of the sound source is positioned at the back of the line passing through the microphones.

This will be briefly described as follows. When no earflap is basically used, front-back confusion occurs with respect to a line (axis) passing through two attached microphones. In order to prevent the front-back confusion, an earflap and microphones are arranged so that the position of a sound source, of which IcLD becomes zero, exists on the line passing through the two microphones. Accordingly, the front-back discrimination can be accomplished.

Figure 6:
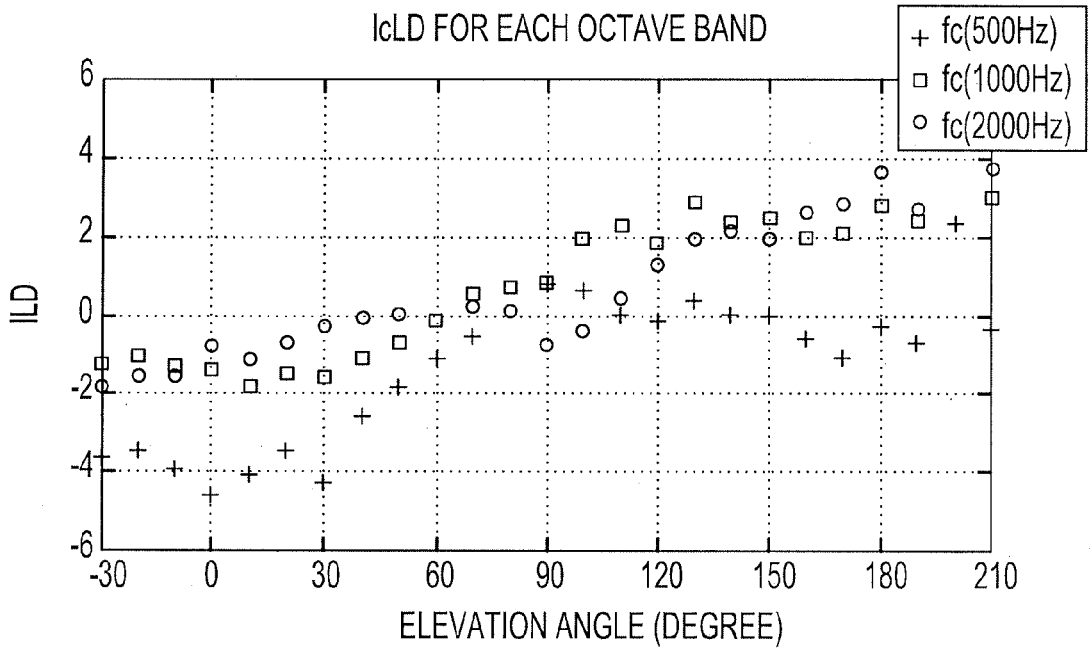
FIG. 6 is a graph showing changes in inter-channel level difference (IcLD) based on each 1/3 octave band.

In FIG. 6, changes in IcLD are shown in 1/3 octave bands, and it can be seen that the IcLD is 0 dB with respect to when the tilt angle of the line passing through the microphones is 60 degrees in a band with a center frequency of 1 kHz. Such a tilt angle is based on the angle at which the artificial ear is attached, and may be changed by a user.

Figure 7:
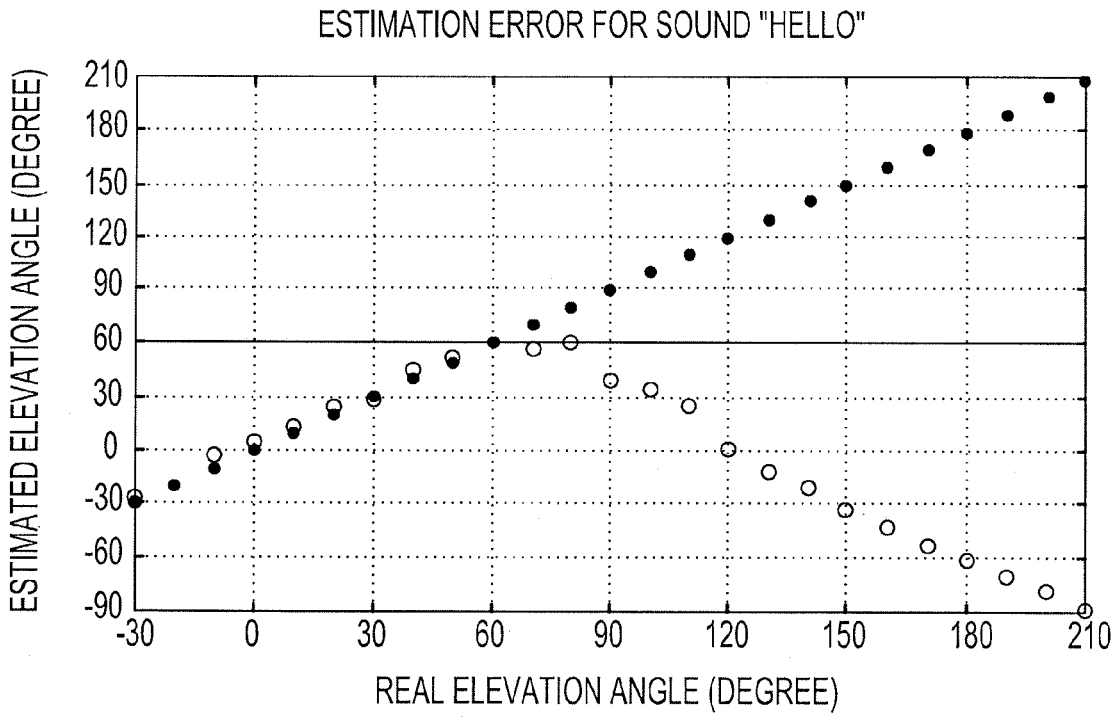
FIGS. 7 and 8 are graphs showing the directions of estimated sounds in the case where the sound source direction detection according to an embodiment of the invention is not performed when sound signals "Hello," and "Nice to see you" are used.
Figure 8:
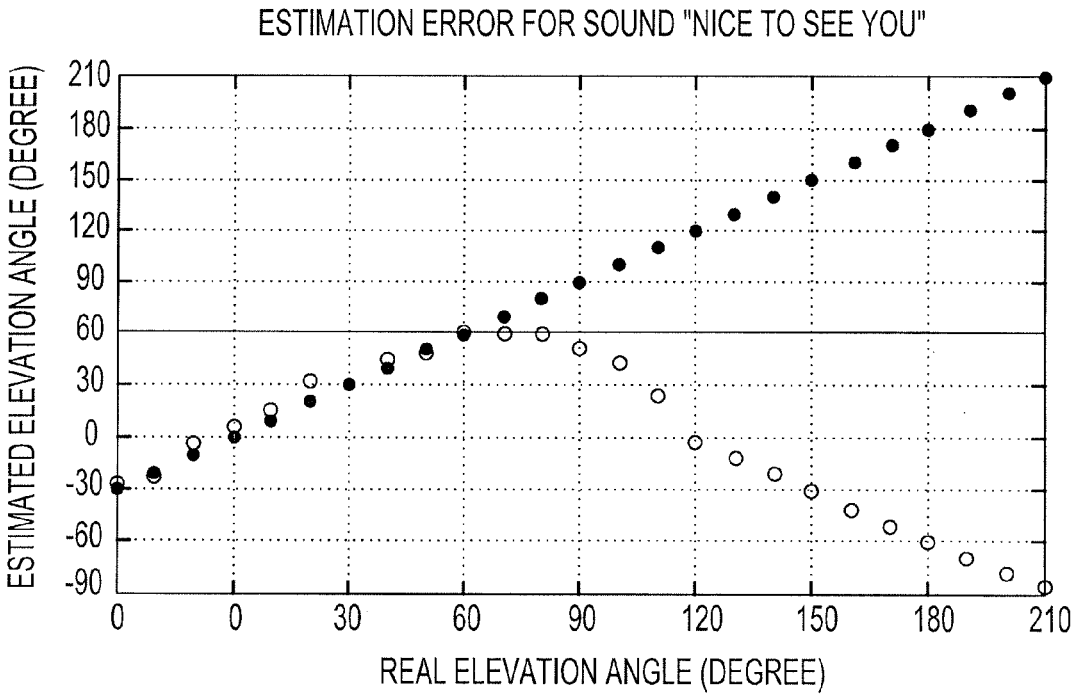

FIGS. 7 and 8 are graphs showing the directions of estimated sound sources in the case where the sound source direction detection according to an embodiment of the invention is not performed when sound signals "Hello," and "Nice to see you" are used. Here, line represented by "*" shows the position of a real sound source, and line represented by "o" shows the position of an estimated sound source. Referring to FIGS. 7 and 8, it can be seen that the front-back confusion occurs with respect to 60 degrees that is an angle at which the artificial ear make a tilt.

Figure 9:
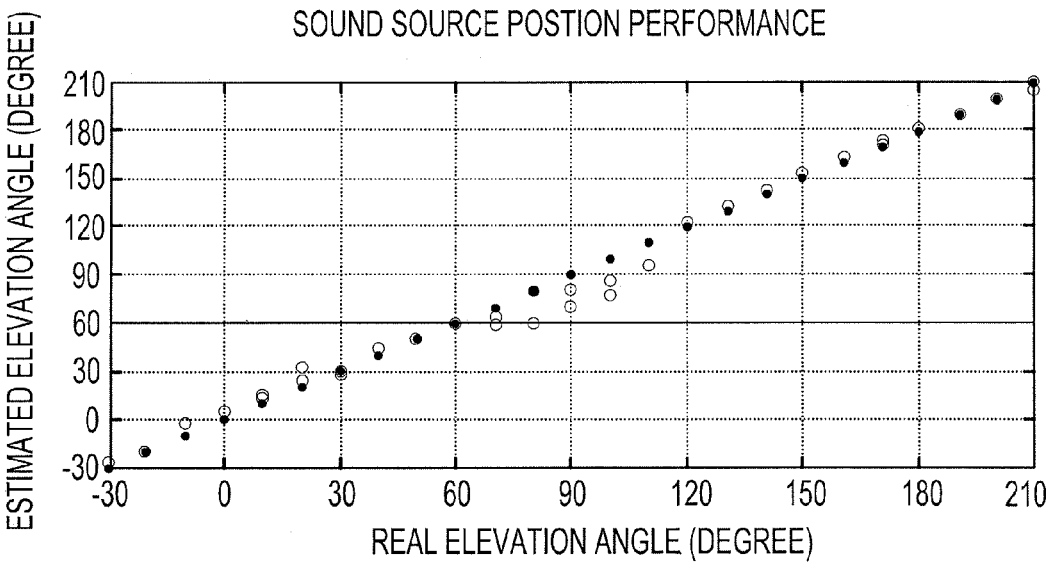
FIG. 9 is a graph showing the directions of the estimated sounds in the case where the sound source direction detection according to an embodiment of the invention is performed.

FIG. 9 is a graph showing the directions of the estimated sounds in the case where the sound source direction detection according to an embodiment of the invention is performed. Here, line represented by "*" shows the position of a real sound source, and line represented by "o" shows the position of an estimated sound source. Referring to FIG. 9, it can be seen that the position of the real sound source is almost identical to that of the estimated sound source.

After such front-back discrimination is accomplished, an angle corresponding to the position of a sound source is determined by a difference between the arrival delay times of output signals of microphones. When the artificial ear disclosed herein is raised from the ground, the angle corresponding to the position of the sound source may be an elevation angle of the sound source. When the artificial ear disclosed herein is laid down on the ground, the angle corresponding to the position of the sound source may be a horizontal angle of the sound source. The difference between the arrival delay times of the output signals may be obtained using the IcTF of Equation 1, which is a transfer function between the positions of the microphones. The group delay of the IcTF, which means a difference in arrival delay time between the microphones, is defined by Equation 3

$$\text{Group Delay} = -\frac{1}{2\pi}\frac{d}{df}(\angle IcTF(f_k)) \quad (3)$$

By applying a free field condition and a far field condition, the angle corresponding to the position of the sound source can be determined from the group delay obtained by Equation 3, and the position of the sound source can be finally estimated.

Figure 10:
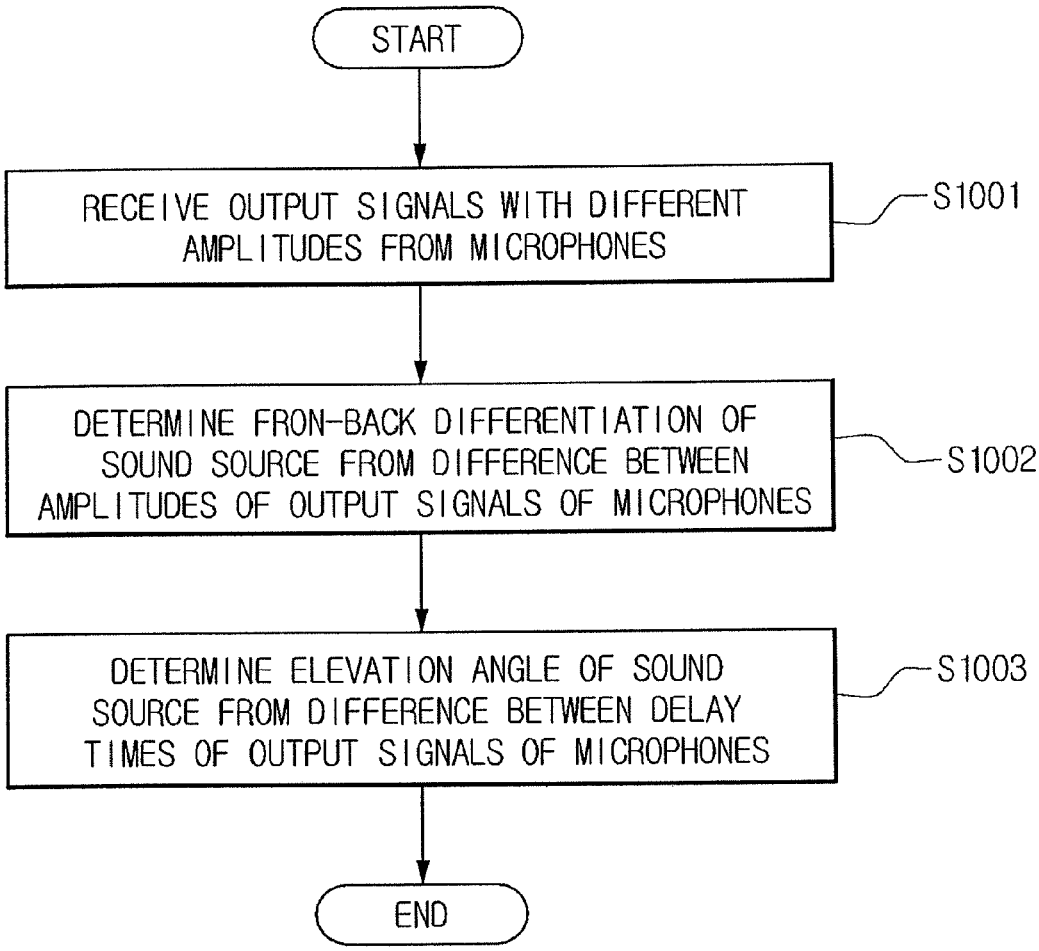
FIG. 10 is a flowchart illustrating a method for detecting the direction of a sound source according to an embodiment.

Referring to FIG. 10, in the method for detecting the direction of a sound source according to this embodiment, output signals having different amplitudes are first received from a plurality of microphones of an artificial ear, respectively (S1001). The difference between the amplitudes of the output signals of the microphones is induced by a structure disposed between the microphones. Subsequently, the front-back discrimination of the sound source is determined from the difference between the amplitudes of the output signals of the microphones (S1002). The determination of the front-back discrimination of the sound source is performed using a difference such as IcLD. After the front-back discrimination of the sound source is determined, an angle corresponding to the position of the sound source is determined from the difference between the delay times of the output signals of the microphones (S1003). As described above, the angle corresponding to the position of the sound source may be an elevation angle or horizontal angle. Through the aforementioned processes, the direction of the sound source can be precisely detected without the front-back confusion.

According to an artificial ear and a method for detecting the direction of a sound source, disclosed herein, the front-back confusion can be prevented, and microphones can be freely arranges in a robot platform as compared with when an array of a plurality of microphones is disposed in the robot platform. Since the amount of output signals to be processed is decreased, the position of the sound source can be easily detected in real time, so that the artificial ear can be applied to various platforms.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method for detecting the direction of a sound source, comprising:

inputting sound signals from a sound source to a plurality of microphones wherein a structure is located between the plurality of microphones;

measuring respective output signals from the plurality of microphones in response to the input sound signals;

determining whether the sound source is in front of or behind the structure, based on the difference between amplitudes of the respective output signals caused by the structure; and determining an angle corresponding to the position of the sound source from a difference between delay times of the respective output signals, wherein in the determining whether the sound source is in front of or behind the structure, when $G_{FB}(f_k)$ denotes a cross power density function between the respective output signals of first and second microphones of said plurality of microphones and $G_{BB}(f_k)$ denotes a power spectral density function of the output signal of the second microphone, an inter-channel transfer function (IcTF) between positions of the microphones is defined as follows:

$$IcTF_{FB}(f_k) = \frac{G_{FB}(f_k)}{G_{BB}(f_k)} = |IcTF(f_k)|e^{j \cdot phase(f_k)}$$

and an inter-channel level difference (IcLD) is defined as follows:

$$IcLD = 20\log_{10}(|IcTF(f)|) = \frac{\sum_{n=0}^{n=N-1} 20\log_{10}(|IcTF_{FB}(f_n)|)df_n}{\sum_{n=0}^{n=N-1} df_n} \text{ dB}$$

wherein, in the determining whether the sound source is in front of or behind the structure, the position of the sound source is determined as a front with respect to a line passing through the first and second microphones when the IcLD is greater than zero, and the position of the sound source is determined as a back with respect to the line passing through the first and second microphones when the IcLD is smaller than zero.

2. The method according to claim 1, wherein the angle corresponding to the position of the sound source is an elevation angle or horizontal angle of the sound source.

3. A method for detecting the direction of a sound source, comprising:

inputting sound signals from a sound source to a plurality of microphones wherein a structure is located between the plurality of microphones;

measuring respective output signals from the plurality of microphones in response to the input sound signals;

determining whether the sound source is in front of or behind the structure, based on the difference between amplitudes of the respective output signals caused by the structure; and determining an angle corresponding to the position of the sound source from a difference between delay times of the respective output signals, wherein, in the determining of the angle corresponding to the position of the sound source, when $G_{FB}(f_k)$ denotes a cross power density function between the respective output signals of the first and second microphones and $G_{BB}(f_k)$ denotes a power spectral density function of the output signal of the second microphone, an inter-channel transfer function (IcTF) that is a transfer function between positions of the microphones is defined as follows;

$$IcTF_{FB}(f_k) = \frac{G_{FB}(f_k)}{G_{BB}(f_k)} = |IcTF(f_k)|e^{j \cdot phase(f_k)},$$

a difference between arrival delay times of the output signals at the first and second microphones is defined as follows;

$$\text{Group Delay} = -\frac{1}{2\pi}\frac{d}{df}(\angle IcTF(f_k)),$$

and the angle corresponding to the position of the sound source is obtained from the difference between the arrival delay times.

* * * * *